United States Patent [19]

Elmore

[11] 4,220,244

[45] Sep. 2, 1980

[54] FRESH FACE PAD

[76] Inventor: Sabra Elmore, 98 Riverside Dr., New York, N.Y. 10024

[21] Appl. No.: 914,067

[22] Filed: Jun. 9, 1978

[51] Int. Cl.[2] ..... B65D 81/22; B65D 81/36; A45C 11/00

[52] U.S. Cl. ..... 206/210; 132/83 R; 206/361; 206/484; 206/628; 229/3.5 MF; 206/812

[58] Field of Search ..... 206/205, 812, 628, 361, 206/484, 803, 210; 132/83 R, 79 G; 401/95, 52; 229/3.5 MF

[56] References Cited

U.S. PATENT DOCUMENTS

| | | | |
|---|---|---|---|
| 2,245,675 | 6/1941 | Hultin | 229/3.5 MF |
| 3,057,467 | 10/1962 | Williams | 206/361 |
| 3,298,593 | 1/1967 | Stephenson | 206/628 |
| 3,563,371 | 2/1971 | Heinz | 206/361 |
| 3,682,987 | 7/1954 | Spiess, Jr. | 229/3.5 MF |

*Primary Examiner*—William T. Dixson, Jr.
*Attorney, Agent, or Firm*—Richard L. Miller

[57] ABSTRACT

A packet containing a soft cloth pad that is saturated with salt water, so as to be readily able to be carried in a packet or purse so as to wipe a person's face for cleaning or refreshing the same; the packet comprising a sealed, moisture proof envelope.

1 Claim, 6 Drawing Figures

Fig. 1
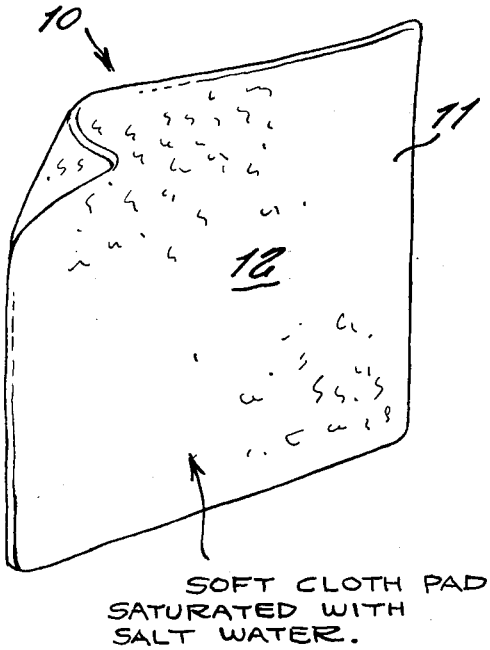
Fig. 2
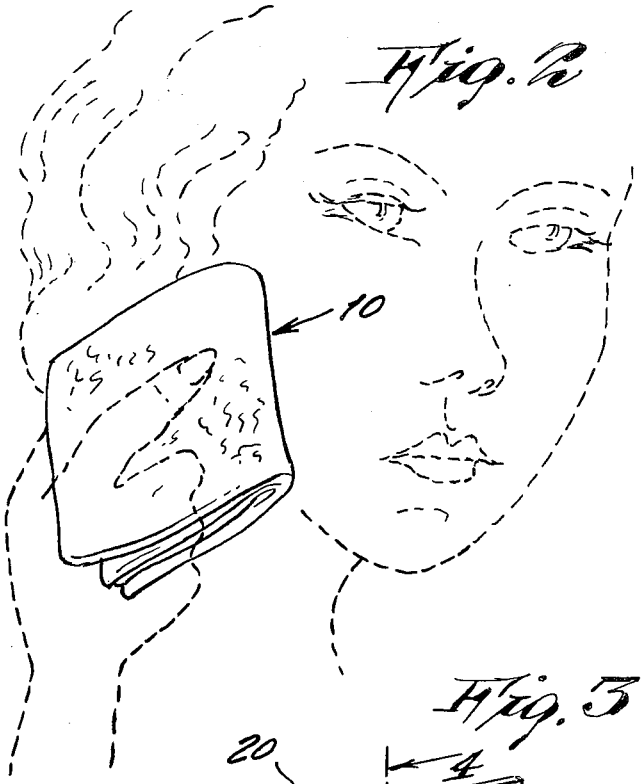
Fig. 3
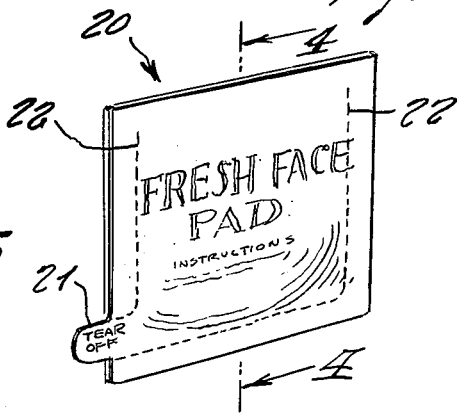
Fig. 5
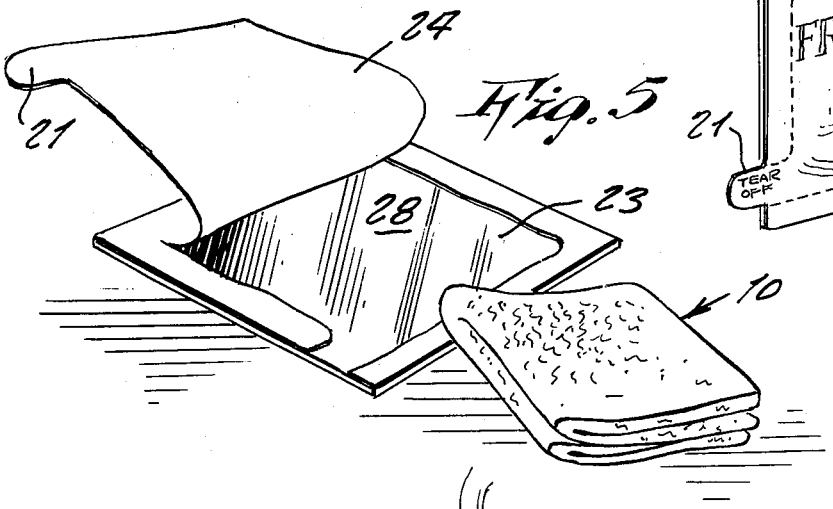
Fig. 4
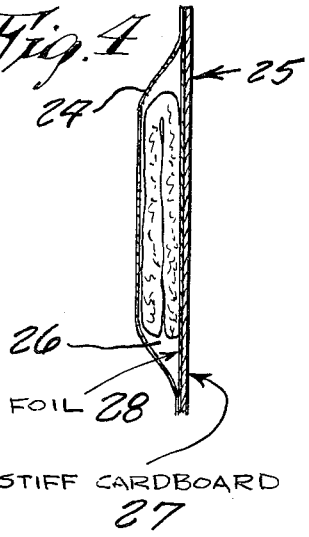
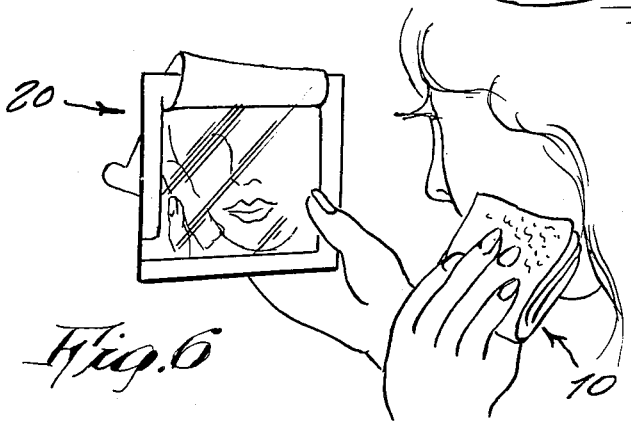
Fig. 6

FRESH FACE PAD

This invention relates generally to face cloths.

A principal object of the present invention is to provide a pad for wiping a person's face; the pad being saturated with a salt water so as to refresh the person as well as cleaning the face.

Another object is to provide a fresh face pad which is enclosed within a moisture-proof envelope so that it can be conveniently carried in a person's pocket or purse in order to always be handy when needed.

Another object is to provide a fresh face pad which in one specific design thereof includes a mirror formed on the enclosing envelope so that it will aid a person to see where the pad is applied on a face.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

FIG. 1 is a view of the pad unfolded.

FIG. 2 is a view thereof shown folded and in use.

FIG. 3 is a perspective view of a moisture-proof packet or envelope in which the pad can be retailed.

FIG. 4 is a cross sectional view taken on line 4—4 of FIG. 3 showing the salt water pad inside the moisture-proof envelope.

FIG. 5 is a perspective view of the envelope torn open and the pad removed, and showing a foiled surface of the envelope suitable for use as a mirror when applying the pad to a skin.

FIG. 6 is a view of the pad in use and the envelope used as a mirror; it being understood that in use the pad can be folded or unfolded as preferred.

Referring now to the drawing in detail, and more particularly to FIGS. 1 and 2 thereof at this time, the reference numeral 10 represents a fresh face pad according to the present invention wherein the same is comprised of a soft cloth 11 that is saturated with salt water 12. The cloth is of square shape and of a size similar to a conventional wash cloth in order to be usable for its intended purpose as a face cloth and is reusable.

Referring now to FIG. 3, the above described fresh face pad is packaged in a moisture-proof packet 20 in order that it retains its moisture until a time for its use. In order that the packet can be easily torn open, a pull tab 21 integral with one side panel of the packet protrudes conveniently beyond a side edge of the packet so as to be pulled and thus tear off a central portion of the panel along scored tear lines 22 and thus provide access for removal of the pad.

The packet 20 can additionally include a mirror surface 23 so as to allow a user to observe how the pad is applied to the face. In this design, shown in FIGS. 4 through 6, the packet is comprised of two panels 24 and 25 glued together along their edges so as to form a pocket 26 that contains the folded pad. The panel 24 which includes the tab 21 and tear line 22 is made of thin metal foil, while the panel 25 comprises a relatively stiff cardboard 27 having a metal foil 28 glued on its inner side. The foils thus seal the moisture inside the packet, while the foil 28 is maintained from getting crinkled up by being secured to the stiff cardboard. Thus it remains smooth and flat so as to serve as the mirror surface 23, as shown in FIG. 6.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A fresh face pad, comprising, in combination, a face cloth and a packet that encloses said face cloth, said face cloth being made of a soft cloth that is saturated with salt water, said packet being moisture-proof so as to prevent drying out of said cloth prior to use thereof; said packet being comprised of two panels glued together along their edges, so as to form a central pocket containing said cloth, one said panel including a tab projecting along its side edge and a tear line aligned with each edge of said tab, so as to allow tearing out a large central opening of said panel and allow removal of said cloth from said pocket while exposing an inner surface of the other said panel, comprising a metal foil glued to a stiff cardboard having the characteristic of not bending, so as to prevent bending said foil, said foil forming an inner side of said panel, and said foil having a reflective mirror surface.

* * * * *